US011648161B2

(12) United States Patent
Son et al.

(10) Patent No.: US 11,648,161 B2
(45) Date of Patent: May 16, 2023

(54) ROBOT

(71) Applicant: LG ELECTRONICS INC., Seoul (KR)

(72) Inventors: Jungkyu Son, Seoul (KR); Jinsu Kim, Seoul (KR); Boyeon Kim, Seoul (KR); Hyesun Lee, Seoul (KR); Bina Kim, Seoul (KR); Mina Suh, Seoul (KR); Jinwon Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 624 days.

(21) Appl. No.: 16/804,196

(22) Filed: Feb. 28, 2020

(65) Prior Publication Data

US 2021/0145666 A1 May 20, 2021

(30) Foreign Application Priority Data

Nov. 18, 2019 (KR) ..... 10-2019-0148108

(51) Int. Cl.

| | |
|---|---|
| ***A61G 5/04*** | (2013.01) |
| ***A61G 5/10*** | (2006.01) |
| ***A61G 5/12*** | (2006.01) |

(52) U.S. Cl.

CPC ..... *A61G 5/045* (2013.01); *A61G 5/10* (2013.01); *A61G 5/125* (2016.11)

(58) Field of Classification Search

CPC ..... A61G 5/045; A61G 5/125; A61G 5/10

See application file for complete search history.

(56) References Cited

U.S. PATENT DOCUMENTS

| | | | | | |
|---|---|---|---|---|---|
| 3,779,095 | A | * | 12/1973 | Audet | G05G 9/047 74/471 XY |
| 3,814,199 | A | * | 6/1974 | Jones | A61G 5/045 318/587 |
| 3,990,319 | A | * | 11/1976 | Hofer | H01H 25/06 74/471 XY |
| 4,296,361 | A | * | 10/1981 | Archer | B62D 11/04 318/67 |
| 4,364,047 | A | * | 12/1982 | Archer | H03K 17/975 318/55 |
| 2009/0000645 | A1 | | 1/2009 | Passegger | |

FOREIGN PATENT DOCUMENTS

| | | | | |
|---|---|---|---|---|
| CN | 110179598 | A * | 8/2019 | A61G 5/04 |
| KR | 10-1273604 | B1 | 6/2013 | |
| KR | 10-2015-0121753 | A | 10/2015 | |

* cited by examiner

*Primary Examiner* — Jacob D Knutson

(74) *Attorney, Agent, or Firm* — Birch, Stewart, Kolasch & Birch, LLP

(57) ABSTRACT

Provided is a robot including a seating body provided with a seat and an armrest body and a steering, the steering housing has an opening in an upper portion thereof and an inner space therein is disposed on the armrest body. The steering includes a handle and a lower portion passing through the opening, the lower portion being accommodated in the inner space and an elevator accommodated in the inner space, the elevator being connected to the lower portion of the steering body to elevate the steering body.

15 Claims, 12 Drawing Sheets

ROBOT

CROSS-REFERENCE TO RELATED APPLICATIONS

This application claims priority to and the benefit of Korean Patent Application No. 10-2019-0148108, filed on Nov. 18, 2019 in the Korean Intellectual Property Office, the disclosure of which is incorporated herein by reference in its entirety.

FIELD OF THE DISCLOSURE

The present invention relates to a robot.

Robots are machines that automatically process given tasks or operate with their own capabilities. The application fields of robots are generally classified into industrial robots, medical robots, aerospace robots, and underwater robots. Recently, communication robots that can communicate with humans by voices or gestures have been increasing.

In recent years, there has been a trend of increasing in number of guidance robots, which provide a variety of guidance services at the airport, government offices, etc., a transport robot for transporting goods, or a boarding robot on which the user boards.

An example of the boarding robot includes a boarding robot and a boarding robot operation system including the same, which is disclosed in Korea Patent Publication No. 10-1273604 published on Jun. 11, 2013. In the boarding robot, a traveling body is disposed on a lower portion of a user seating portion, the user seating portion is coupled to the traveling body so as to be adjustable in height, a steering device for controlling a driving wheel is provided in front of the traveling body, and a controller for adjusting a traveling state is provided in front of the traveling body.

The boarding robot disclosed in Korean Patent Publication No. 10-1273604 is provided with a steering device in front of the traveling body. As a result, the user's boarding may be uncomfortable in that the user should be seated at a user seating portion while avoiding the steering device.

Another example of the boarding robot includes a boarding robot that employs an omnidirectional wheel disclosed in Korea Patent Publication No. 10-2015-0121753, published on Oct. 30, 2015). The boarding robot is provided with a steering device installed to be disposed in front of a seat so as to indicate a traveling direction of the boarding robot and a display device installed on an upper end of a main shaft. The steering device may be a joystick device that allows the user to input the travel direction by using a direction indicating bar. The joystick device includes a stick joystick and an armrest and is fixedly installed and supported on the main shaft by a coupling frame.

The steering device disclosed in Korean Patent Publication No. 10-2015-0121753 is exposed to the outside at all times. As a result, it is easy to be contaminated by foreign substances such as dust, and the steering device is easily damaged by external impact.

SUMMARY

Embodiments provide a robot that is capable of minimizing contamination and damage of a steering.

Embodiments also provide a robot that is capable of minimizing possibility of theft.

In an embodiment, a robot includes: a seating body provided with a seat and an armrest body; and a steering, wherein a steering housing having an opening in an upper portion thereof and an inner space therein is disposed on the armrest body, and the steering includes: a steering body; and an elevator configured to elevate the steering body.

The steering body may be provided with an upper portion on which a handle is provided and a lower portion passing through the opening, and the lower portion may be accommodated in the inner space.

The elevator may be accommodated in the inner space and be connected to the lower portion of the steering body to elevate the steering body.

An accommodation portion into which the steering housing is inserted and accommodated may be recessed from the armrest body.

The steering may further include an inner cover connected to the steering body to block the opening when the steering body ascends.

The elevator may be configured to allow the handle to ascend above the opening or descend to the opening.

When the handle descends to the opening, the opening may be configured to surround an outer circumference of the handle.

A vertical length of the inner space may be longer than a vertical length of the steering body.

The elevator may include: a motor accommodated in the steering housing; and a lever which is connected to a rotation shaft of the motor to rotate and to which a connection shaft disposed on a lower portion of the steering body is connected.

A guide hole configured to guide the connection shaft may be lengthily defined in the lever in a longitudinal direction of the lever.

The robot may further include a display rotatably connected to the steering housing.

The display may have a size greater than a size of the opening, and when the display rotates to cover a top surface of the steering housing, the display may be configured to cover the opening.

The display may be connected to a front end of the steering housing. The display may have a size greater than a size of a top surface of the steering housing. When the display rotates to cover the top surface of the steering housing, the display may be configured to cover a boundary between the steering housing and the armrest body.

In another embodiment, a robot includes: a seating body provided with a seat and a pair of armrest bodies, in which accommodation portions are defined, respectively; a steering housing which is disposed in one accommodation portion of the pair of armrest bodies; a steering disposed in the steering housing; and an accessory disposed in the other accommodation portion of the pair of armrest bodies.

An opening may be defined in an upper portion of the steering housing, and an inner space may be defined in the steering housing.

A handle may be disposed on an upper portion of the steering, and the steering may pass through the opening. A lower portion of the steering may be accommodated in an inner space.

The robot may include the elevator accommodated in the inner space to elevate the steering body.

The steering housing and the accessory may be selectively disposed on the pair of armrest bodies.

The robot may further include a display rotatably disposed to the steering housing.

A display connection portion to which the display is connected may be disposed in the steering housing.

The display connection portion may be horizontally spaced apart from the steering body when the steering body ascends.

The display may have a length that is longer than a distance between the display connection portion and the opening.

The steering may further include an inner cover connected to the steering body to block the opening when the steering body ascends.

When the steering body descends, and the display rotates to cover a top surface of the steering housing, the display may be disposed above the opening to cover the opening.

In further another embodiment, a robot includes: a seating body provided with a seat and an armrest, wherein an opening is defined in the armrest, and an inner space is defined in the armrest; a steering body provided with an upper portion on which a handle is provided and a lower portion passing through the opening, the lower portion being accommodated in the inner space; and an elevator accommodated in the inner space, the elevator being connected to the lower portion of the steering body to elevate the steering body.

The robot may further include an inner cover connected to the steering body to block the opening when the steering body ascends.

A vertical length of the inner space may be longer than a vertical length of the steering body.

The elevator may include: a motor accommodated in the inner space; and a lever which is connected to a rotation shaft of the motor to rotate and to which a connection shaft disposed on a lower portion of the steering body is connected.

The robot may further include a display rotatably connected to the steering housing. The display may be rotatably connected to the steering housing to cover the opening when the display rotates to cover a top surface of the steering housing.

The details of one or more implementations are set forth in the accompanying drawings and the description below. Other features will be apparent from the description and drawings, and from the claims.

DETAILED DESCRIPTION OF THE EMBODIMENTS

Figure 1:
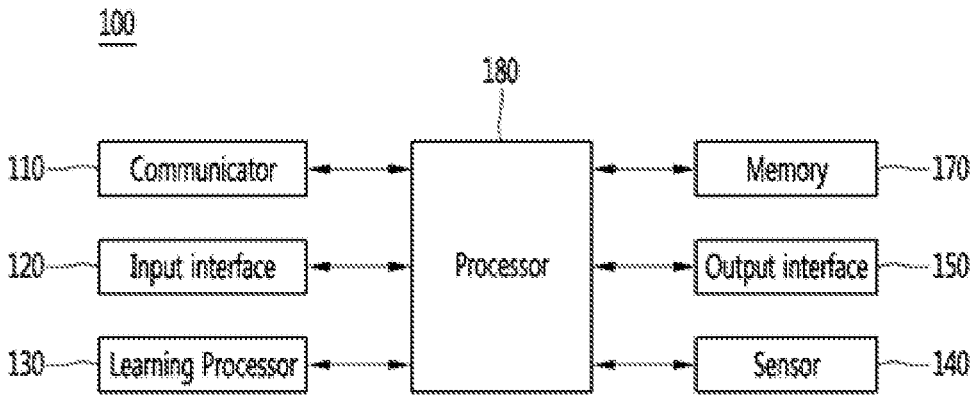
FIG. 1 is a view illustrating an AI device constituting a robot system according to an embodiment.

Hereinafter, detailed embodiments will be described in detail with reference to the accompanying drawings.

<Robot>

A robot may refer to a machine that automatically processes or operates a given task by its own ability. In particular, a robot having a function of recognizing an environment and performing a self-determination operation may be referred to as an intelligent robot.

Robots may be classified into industrial robots, medical robots, home robots, military robots, and the like according to the use purpose or field.

The robot includes a driving unit may include an actuator or a motor and may perform various physical operations such as moving a robot joint. In addition, a movable robot may include a wheel, a brake, a propeller, and the like in a driving unit, and may travel on the ground through the driving unit or fly in the air.

<Artificial Intelligence (AI)>

Artificial intelligence refers to the field of studying artificial intelligence or methodology for making artificial intelligence, and machine learning refers to the field of defining various issues dealt with in the field of artificial intelligence and studying methodology for solving the various issues. Machine learning is defined as an algorithm that enhances the performance of a certain task through a steady experience with the certain task.

An artificial neural network (ANN) is a model used in machine learning and may mean a whole model of problem-solving ability which is composed of artificial neurons (nodes) that form a network by synaptic connections. The artificial neural network can be defined by a connection pattern between neurons in different layers, a learning process for updating model parameters, and an activation function for generating an output value.

The artificial neural network may include an input layer, an output layer, and optionally one or more hidden layers. Each layer includes one or more neurons, and the artificial neural network may include a synapse that links neurons to neurons. In the artificial neural network, each neuron may output the function value of the activation function for input signals, weights, and deflections input through the synapse.

Model parameters refer to parameters determined through learning and include a weight value of synaptic connection and deflection of neurons. A hyperparameter means a parameter to be set in the machine learning algorithm before learning, and includes a learning rate, a repetition number, a mini batch size, and an initialization function.

The purpose of the learning of the artificial neural network may be to determine the model parameters that minimize a loss function. The loss function may be used as an index to determine optimal model parameters in the learning process of the artificial neural network.

Machine learning may be classified into supervised learning, unsupervised learning, and reinforcement learning according to a learning method.

The supervised learning may refer to a method of learning an artificial neural network in a state in which a label for learning data is given, and the label may mean the correct answer (or result value) that the artificial neural network may infer when the learning data is input to the artificial neural network. The unsupervised learning may refer to a method of learning an artificial neural network in a state in which a label for learning data is not given. The reinforcement learning may refer to a learning method in which an agent defined in a certain environment learns to select a behavior or a behavior sequence that maximizes cumulative compensation in each state.

Machine learning, which is implemented as a deep neural network (DNN) including a plurality of hidden layers among artificial neural networks, is also referred to as deep learning, and the deep learning is part of machine learning. In the following, machine learning is used to mean deep learning.

<Self-Driving>

Self-driving refers to a technique of driving for oneself, and a self-driving vehicle refers to a vehicle that travels without an operation of a user or with a minimum operation of a user.

For example, the self-driving may include a technology for maintaining a lane while driving, a technology for automatically adjusting a speed, such as adaptive cruise control, a technique for automatically traveling along a predetermined route, and a technology for automatically setting and traveling a route when a destination is set.

The vehicle may include a vehicle having only an internal combustion engine, a hybrid vehicle having an internal combustion engine and an electric motor together, and an electric vehicle having only an electric motor, and may include not only an automobile but also a train, a motorcycle, and the like.

At this time, the self-driving vehicle may be regarded as a robot having a self-driving function.

FIG. 1 illustrates an AI device 100 including a robot according to an embodiment of the present invention.

The AI device 100 may be implemented by a stationary device or a mobile device, such as a TV, a projector, a mobile phone, a smartphone, a desktop computer, a notebook, a digital broadcasting terminal, a personal digital assistant (PDA), a portable multimedia player (PMP), a navigation device, a tablet PC, a wearable device, a set-top box (STB), a DMB receiver, a radio, a washing machine, a refrigerator, a desktop computer, a digital signage, a robot, a vehicle, and the like.

Referring to FIG. 1, the AI device 100 may include a communicator 110, an input interface 120, a learning processor 130, a sensor 140, an output interface 150, a memory 170, and a processor 180.

The communicator 110 may transmit and receive data to and from external devices such as other AI devices 100*a* to 100*e* and the AI server 500 by using wire/wireless communication technology. For example, the communicator 110 may transmit and receive sensor information, a user input, a learning model, and a control signal to and from external devices.

The communication technology used by the communicator 110 includes GSM (Global System for Mobile communication), CDMA (Code Division Multi Access), LTE (Long Term Evolution), 5G, WLAN (Wireless LAN), Wi-Fi (Wireless-Fidelity), Bluetooth™, RFID (Radio Frequency Identification), Infrared Data Association (IrDA), ZigBee, NFC (Near Field Communication), and the like.

The input interface 120 may acquire various kinds of data.

At this time, the input interface 120 may include a camera for inputting a video signal, a microphone for receiving an audio signal, and a user input interface for receiving information from a user. The camera or the microphone may be treated as a sensor, and the signal acquired from the camera or the microphone may be referred to as sensing data or sensor information.

The input interface 120 may acquire a learning data for model learning and an input data to be used when an output is acquired by using learning model. The input interface 120 may acquire raw input data. In this case, the processor 180 or the learning processor 130 may extract an input feature by preprocessing the input data.

The learning processor 130 may learn a model composed of an artificial neural network by using learning data. The learned artificial neural network may be referred to as a learning model. The learning model may be used to an infer result value for new input data rather than learning data, and the inferred value may be used as a basis for determination to perform a certain operation.

At this time, the learning processor 130 may perform AI processing together with the learning processor 540 of the AI server 500.

At this time, the learning processor 130 may include a memory integrated or implemented in the AI device 100. Alternatively, the learning processor 130 may be implemented by using the memory 170, an external memory directly connected to the AI device 100, or a memory held in an external device.

The sensor 140 may acquire at least one of internal information about the AI device 100, ambient environment information about the AI device 100, and user information by using various sensors.

Examples of the sensors included in the sensor 140 may include a proximity sensor, an illuminance sensor, an acceleration sensor, a magnetic sensor, a gyro sensor, an inertial sensor, an RGB sensor, an IR sensor, a fingerprint recognition sensor, an ultrasonic sensor, an optical sensor, a microphone, a lidar, and a radar.

The output interface 150 may generate an output related to a visual sense, an auditory sense, or a haptic sense.

At this time, the output interface 150 may include a display unit for outputting time information, a speaker for outputting auditory information, and a haptic module for outputting haptic information.

The memory 170 may store data that supports various functions of the AI device 100. For example, the memory 170 may store input data acquired by the input interface 120, learning data, a learning model, a learning history, and the like.

The processor 180 may determine at least one executable operation of the AI device 100 based on information determined or generated by using a data analysis algorithm or a machine learning algorithm. The processor 180 may control the components of the AI device 100 to execute the determined operation.

To this end, the processor 180 may request, search, receive, or utilize data of the learning processor 130 or the memory 170. The processor 180 may control the components of the AI device 100 to execute the predicted operation or the operation determined to be desirable among the at least one executable operation.

When the connection of an external device is required to perform the determined operation, the processor 180 may generate a control signal for controlling the external device and may transmit the generated control signal to the external device.

The processor 180 may acquire intention information for the user input and may determine the user's requirements based on the acquired intention information.

The processor 180 may acquire the intention information corresponding to the user input by using at least one of a speech to text (STT) engine for converting speech input into a text string or a natural language processing (NLP) engine for acquiring intention information of a natural language.

At least one of the STT engine or the NLP engine may be configured as an artificial neural network, at least part of which is learned according to the machine learning algorithm. At least one of the STT engine or the NLP engine may be learned by the learning processor 130, may be learned by the learning processor 540 of the AI server 500, or may be learned by their distributed processing.

The processor 180 may collect history information including the operation contents of the AI apparatus 100 or the user's feedback on the operation and may store the collected history information in the memory 170 or the learning processor 130 or transmit the collected history information to the external device such as the AI server 500. The collected history information may be used to update the learning model.

The processor 180 may control at least part of the components of AI device 100 so as to drive an application program stored in memory 170. Furthermore, the processor 180 may operate two or more of the components included in the AI device 100 in combination so as to drive the application program.

Figure 2:
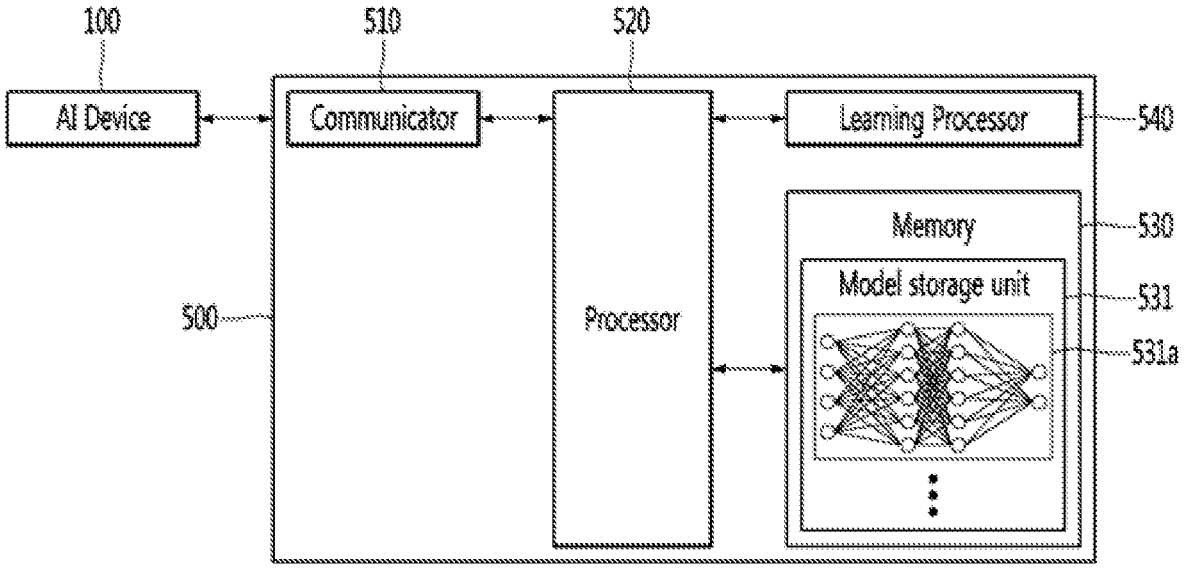
FIG. 2 is a view illustrating an AI server of a robot system according to an embodiment.

FIG. 2 illustrates an AI server 500 connected to a robot according to an embodiment of the present invention.

Referring to FIG. 2, the AI server 500 may refer to a device that learns an artificial neural network by using a machine learning algorithm or uses a learned artificial neural network. The AI server 500 may include a plurality of servers to perform distributed processing, or may be defined as a 5G network. At this time, the AI server 500 may be included as a partial configuration of the AI device 100, and may perform at least part of the AI processing together.

The AI server 500 may include a communicator 510, a memory 530, a learning processor 540, a processor 520, and the like.

The communicator 510 can transmit and receive data to and from an external device such as the AI device 100.

The memory 530 may include a model storage unit 531. The model storage unit 531 may store a learning or learned model (or an artificial neural network 531*a*) through the learning processor 540.

The learning processor 540 may learn the artificial neural network 531*a* by using the learning data. The learning model may be used in a state of being mounted on the AI server 500 of the artificial neural network, or may be used in a state of being mounted on an external device such as the AI device 100.

The learning model may be implemented in hardware, software, or a combination of hardware and software. If all or part of the learning models are implemented in software, one or more instructions that constitute the learning model may be stored in memory 530.

The processor 520 may infer the result value for new input data by using the learning model and may generate a response or a control command based on the inferred result value.

Figure 3:
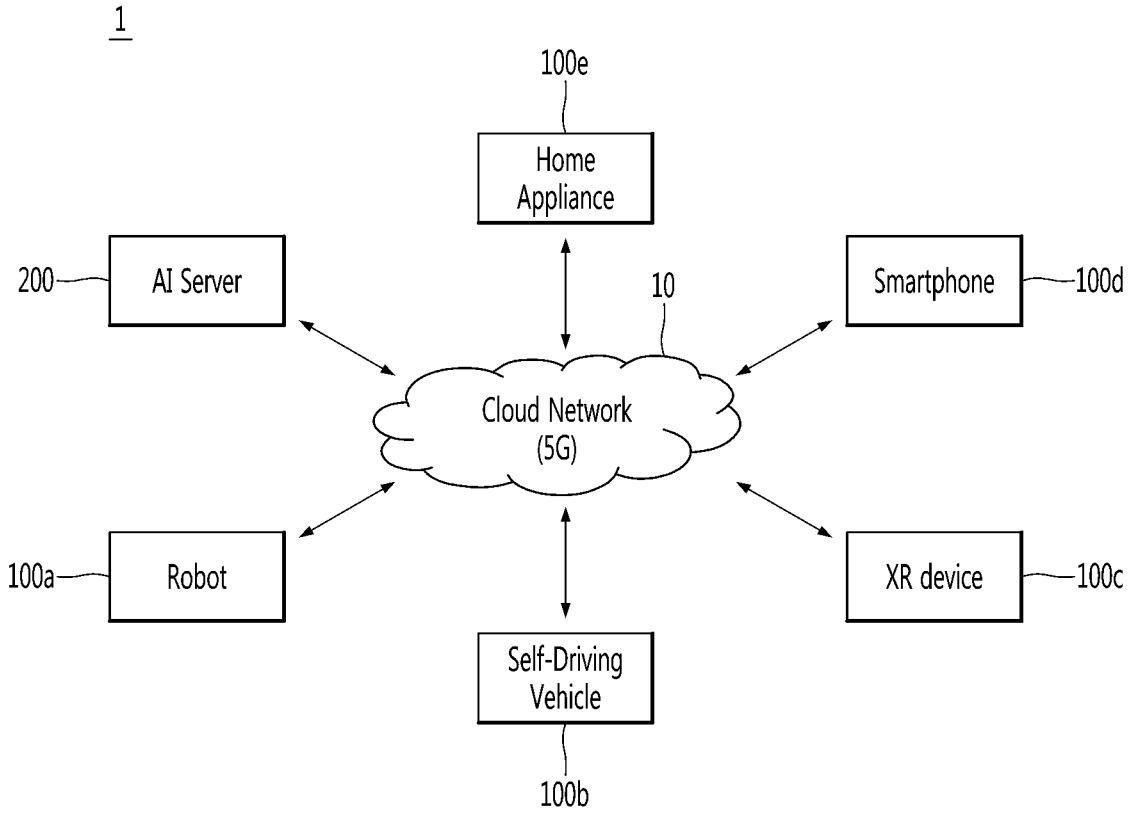
FIG. 3 is a view illustrating an AI system to which a robot system according to an embodiment is applied.

FIG. 3 illustrates an AI system 1 according to an embodiment of the present invention.

Referring to FIG. 3, in the AI system 1, at least one of an AI server 500, a robot 100*a*, a self-driving vehicle 100*b*, an XR device 100*c*, a smartphone 100*d*, or a home appliance 100*e* is connected to a cloud network 10. The robot 100*a*, the self-driving vehicle 100*b*, the XR device 100*c*, the smartphone 100*d*, or the home appliance 100*e*, to which the AI technology is applied, may be referred to as AI devices 100*a* to 100*e*.

The cloud network 10 may refer to a network that forms part of a cloud computing infrastructure or exists in a cloud computing infrastructure. The cloud network 10 may be configured by using a 3G network, a 4G or LTE network, or a 5G network.

That is, the devices 100*a* to 100*e* and 500 configuring the AI system 1 may be connected to each other through the cloud network 10. In particular, each of the devices 100*a* to 100*e* and 500 may communicate with each other through a base station, but may directly communicate with each other without using a base station.

The AI server 500 may include a server that performs AI processing and a server that performs operations on big data.

The AI server 500 may be connected to at least one of the AI devices constituting the AI system 1, that is, the robot 100*a*, the self-driving vehicle 100*b*, the XR device 100*c*, the smartphone 100*d*, or the home appliance 100*e* through the cloud network 10, and may assist at least part of AI processing of the connected AI devices 100*a* to 100*e*.

At this time, the AI server 500 may learn the artificial neural network according to the machine learning algorithm instead of the AI devices 100*a* to 100*e*, and may directly store the learning model or transmit the learning model to the AI devices 100*a* to 100*e*.

At this time, the AI server 500 may receive input data from the AI devices 100*a* to 100*e*, may infer the result value for the received input data by using the learning model, may generate a response or a control command based on the inferred result value, and may transmit the response or the control command to the AI devices 100*a* to 100*e*.

Alternatively, the AI devices 100*a* to 100*e* may infer the result value for the input data by directly using the learning model, and may generate the response or the control command based on the inference result.

Hereinafter, various embodiments of the AI devices 100*a* to 100*e* to which the above-described technology is applied will be described. The AI devices 100*a* to 100*e* illustrated in FIG. 3 may be regarded as a specific embodiment of the AI device 100 illustrated in FIG. 1.

<AI+Robot>

The robot 100*a*, to which the AI technology is applied, may be implemented as a guide robot, a carrying robot, a cleaning robot, a wearable robot, an entertainment robot, a pet robot, an unmanned flying robot, or the like.

The robot 100*a* may include a robot control module for controlling the operation, and the robot control module may refer to a software module or a chip implementing the software module by hardware.

The robot 100*a* may acquire state information about the robot 100*a* by using sensor information acquired from various kinds of sensors, may detect (recognize) surrounding environment and objects, may generate map data, may determine the route and the travel plan, may determine the response to user interaction, or may determine the operation.

The robot 100*a* may use the sensor information acquired from at least one sensor among the lidar, the radar, and the camera so as to determine the travel route and the travel plan.

The robot 100*a* may perform the above-described operations by using the learning model composed of at least one artificial neural network. For example, the robot 100*a* may recognize the surrounding environment and the objects by using the learning model, and may determine the operation by using the recognized surrounding information or object information. The learning model may be learned directly from the robot 100*a* or may be learned from an external device such as the AI server 500.

At this time, the robot 100*a* may perform the operation by generating the result by directly using the learning model, but the sensor information may be transmitted to the external device such as the AI server 500 and the generated result may be received to perform the operation.

The robot 100*a* may use at least one of the map data, the object information detected from the sensor information, or the object information acquired from the external apparatus to determine the travel route and the travel plan, and may control the driving unit such that the robot 100*a* travels along the determined travel route and travel plan.

The map data may include object identification information about various objects arranged in the space in which the robot 100*a* moves. For example, the map data may include object identification information about fixed objects such as walls and doors and movable objects such as pollen and desks. The object identification information may include a name, a type, a distance, and a position.

In addition, the robot 100*a* may perform the operation or travel by controlling the driving unit based on the control/interaction of the user. At this time, the robot 100*a* may acquire the intention information of the interaction due to the user's operation or speech utterance, and may determine the response based on the acquired intention information, and may perform the operation.

<AI+Robot+Self-Driving>

The robot 100*a*, to which the AI technology and the self-driving technology are applied, may be implemented as a guide robot, a carrying robot, a cleaning robot, a wearable robot, an entertainment robot, a pet robot, an unmanned flying robot, or the like.

The robot 100*a*, to which the AI technology and the self-driving technology are applied, may refer to the robot itself having the self-driving function or the robot 100*a* interacting with the self-driving vehicle 100*b*.

The robot 100*a* having the self-driving function may collectively refer to a device that moves for itself along the given movement line without the user's control or moves for itself by determining the movement line by itself.

The robot 100*a* and the self-driving vehicle 100*b* having the self-driving function may use a common sensing method so as to determine at least one of the travel route or the travel plan. For example, the robot 100*a* and the self-driving vehicle 100*b* having the self-driving function may determine at least one of the travel route or the travel plan by using the information sensed through the lidar, the radar, and the camera.

The robot 100*a* that interacts with the self-driving vehicle 100*b* exists separately from the self-driving vehicle 100*b* and may perform operations interworking with the self-driving function of the self-driving vehicle 100*b* or interworking with the user who rides on the self-driving vehicle 100*b*.

At this time, the robot 100*a* interacting with the self-driving vehicle 100*b* may control or assist the self-driving function of the self-driving vehicle 100*b* by acquiring sensor information on behalf of the self-driving vehicle 100*b* and providing the sensor information to the self-driving vehicle 100*b*, or by acquiring sensor information, generating environment information or object information, and providing the information to the self-driving vehicle 100*b*.

Alternatively, the robot 100*a* interacting with the self-driving vehicle 100*b* may monitor the user boarding the self-driving vehicle 100*b*, or may control the function of the self-driving vehicle 100*b* through the interaction with the user. For example, when it is determined that the driver is in a drowsy state, the robot 100*a* may activate the self-driving function of the self-driving vehicle 100*b* or assist the control of the driving unit of the self-driving vehicle 100*b*. The function of the self-driving vehicle 100*b* controlled by the robot 100*a* may include not only the self-driving function but also the function provided by the navigation system or the audio system provided in the self-driving vehicle 100*b*.

Alternatively, the robot 100*a* that interacts with the self-driving vehicle 100*b* may provide information or assist the function to the self-driving vehicle 100*b* outside the self-driving vehicle 100*b*. For example, the robot 100*a* may provide traffic information including signal information and the like, such as a smart signal, to the self-driving vehicle 100*b*, and automatically connect an electric charger to a charging port by interacting with the self-driving vehicle 100*b* like an automatic electric charger of an electric vehicle.

Hereinafter, the robot 100*a* will be described as an example of the boarding robot on which the user is capable of boarding.

Figure 4:
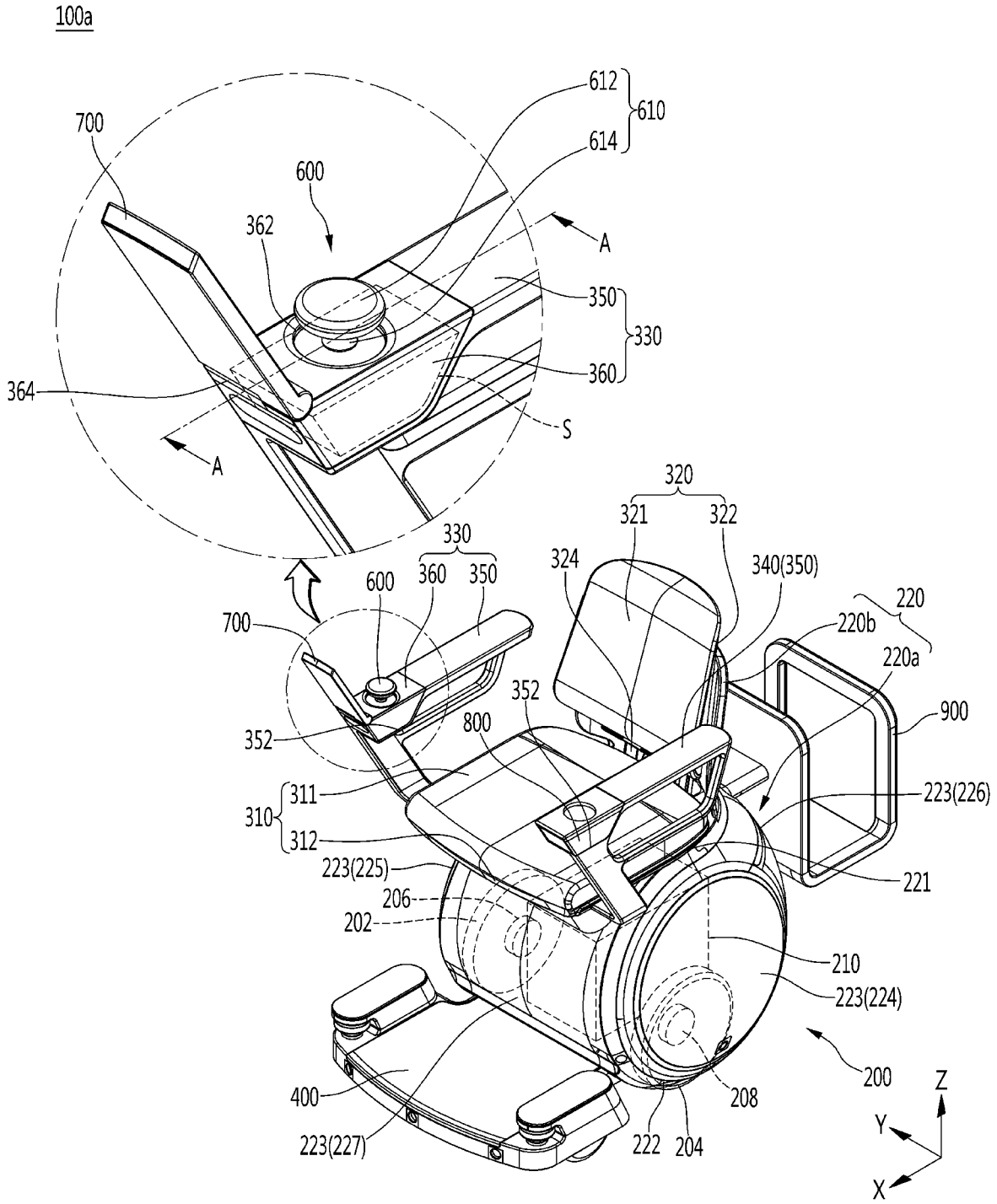
FIG. 4 is a perspective view of a robot according to an embodiment.
Figure 5:
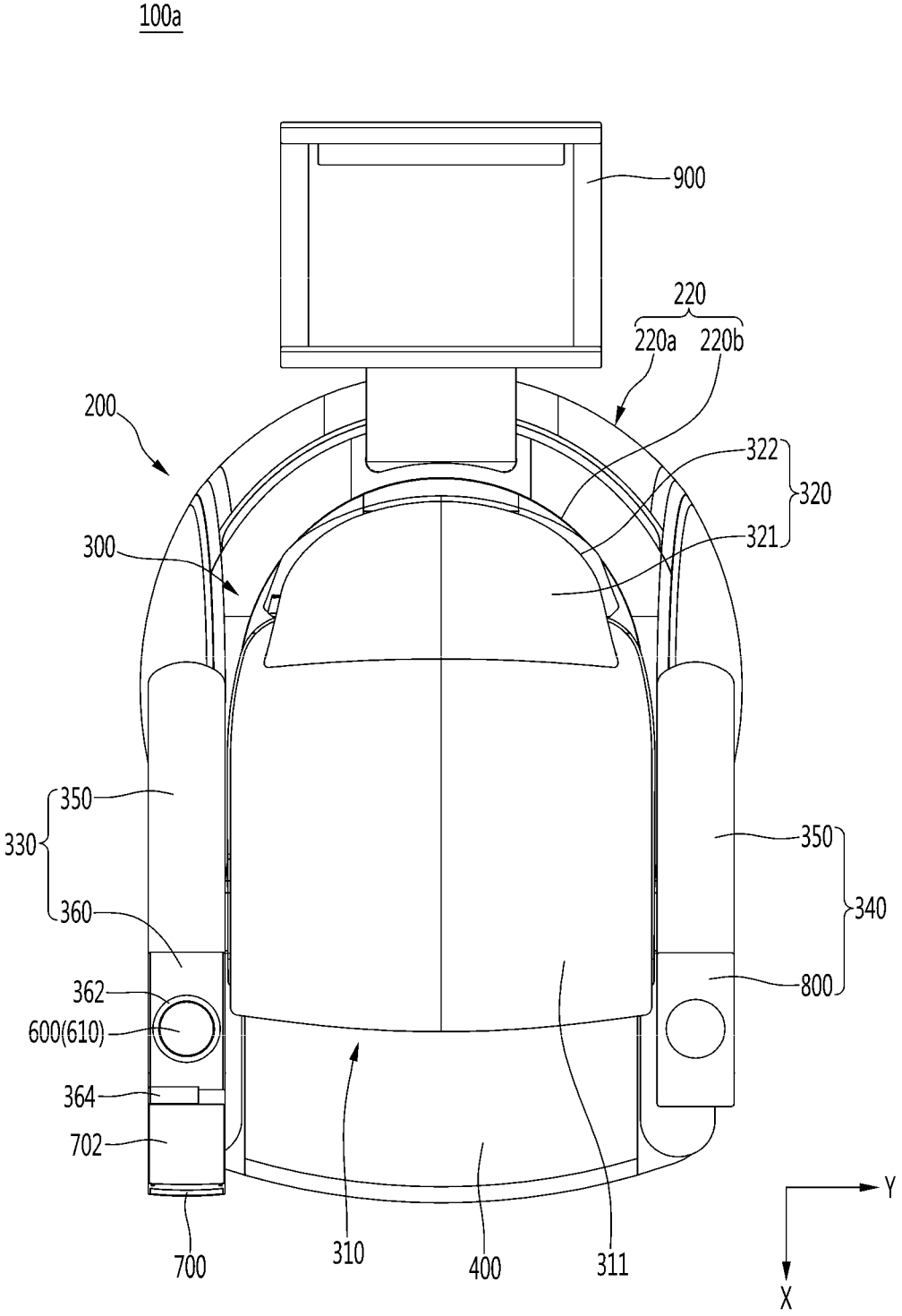
FIG. 5 is a plan view of the robot according to an embodiment.
Figure 6:
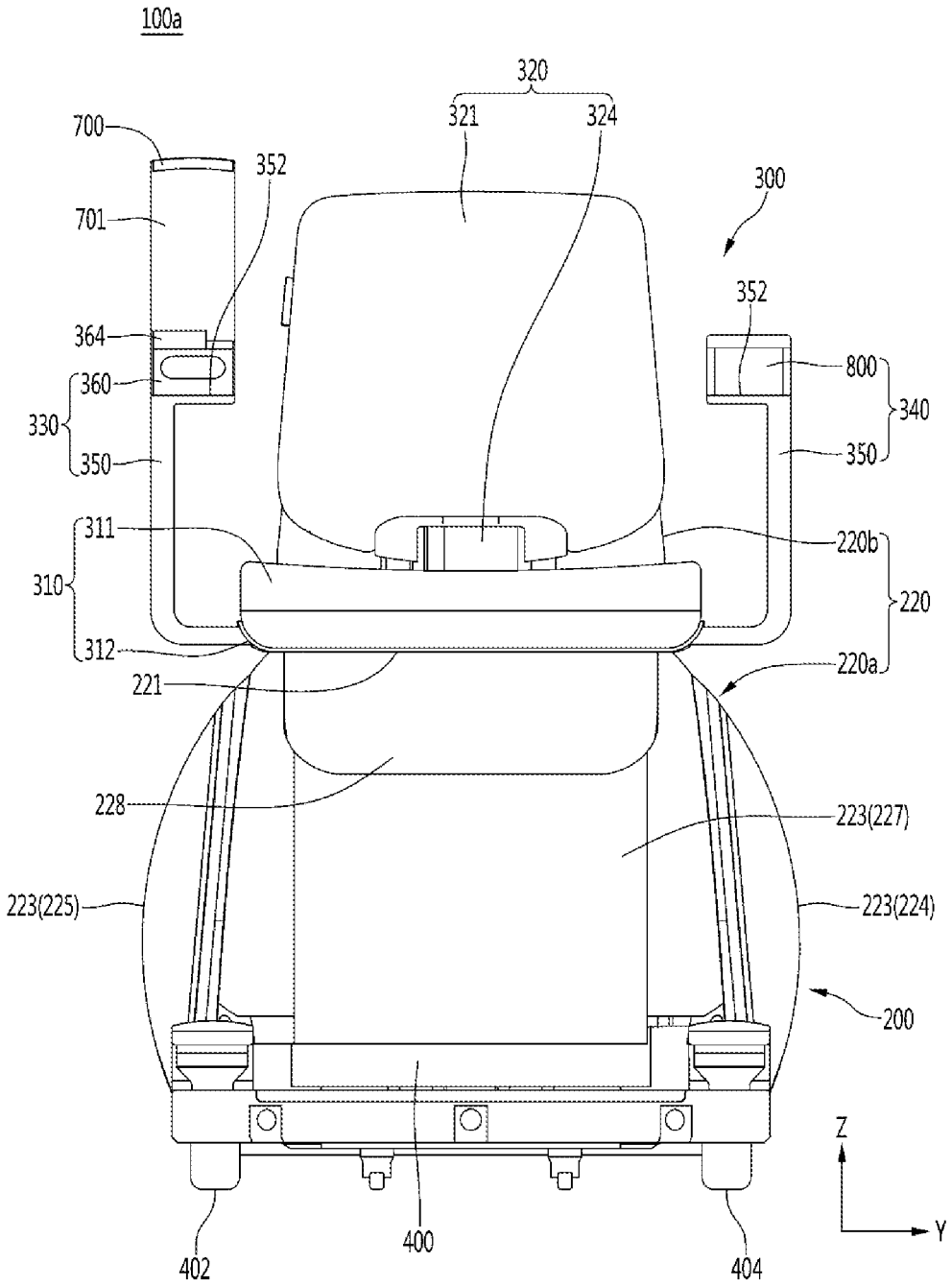
FIG. 6 is a front view of the robot according to an embodiment.
Figure 7:
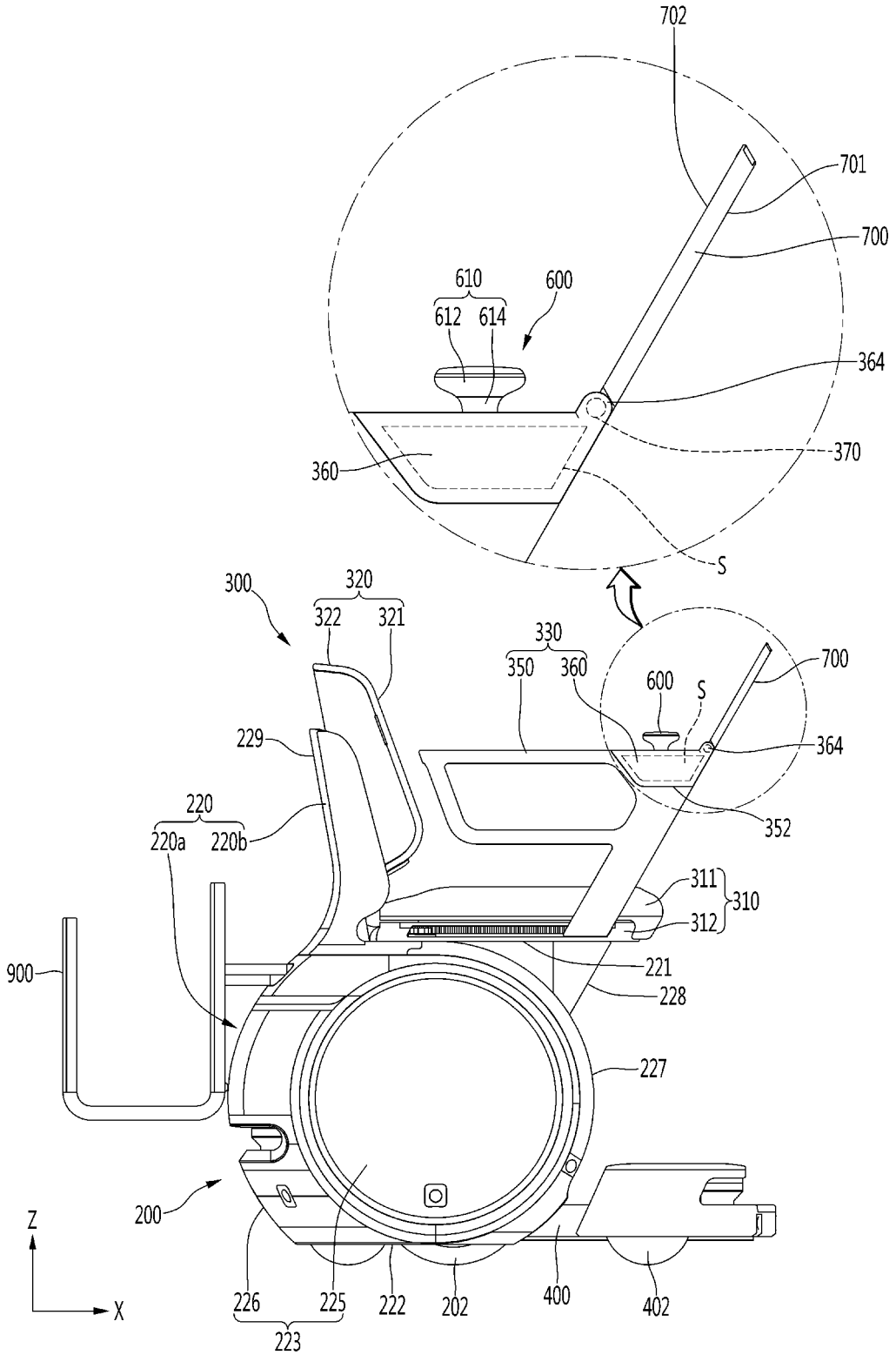
FIG. 7 is a side view of the robot according to an embodiment.

FIG. 4 is a perspective view of a robot according to an embodiment, FIG. 5 is a plan view of the robot according to an embodiment, FIG. 6 is a front view of the robot according to an embodiment, and FIG. 7 is a side view of the robot according to an embodiment.

The robot 100*a* may include a main body 200.

The main body 200 may include at least one traveling wheel and may be a traveling module or a mobile robot that is capable of traveling according to a user's input or autonomously traveling.

The main body 200 may be an assembly of a plurality of parts, and the main body 200 may further include a driving mechanism (or traveling mechanism) that is connected to the traveling wheel to allow the traveling wheel to rotate forward and backward.

The traveling wheel may be provided in a pair on the main body 200. The pair of traveling wheels 202 and 204 may be provided on the main body 200 so as to be spaced apart from each other in a left-right direction (i.e., horizontal direction) Y.

The driving mechanism may include a traveling motor generating driving force for allowing the traveling wheels 202 and 204 to rotate. In an example of the driving mechanism, the traveling motor may be directly connected to the traveling wheels 202 and 204 so that the traveling wheels 202 and 204 directly rotate forward and backward by the traveling motor. In another example of the driving mechanism, the traveling motor may be connected to the traveling wheels 202 and 204 through various power transmission members such as a rotation shaft and gears to allow the traveling wheels 202 and 204 to rotate forward and backward through the power transmission member.

The main body 200 may include a separate steering wheel disposed to be spaced apart from the traveling wheels 202 and 204 so as to switch a traveling direction of the robot 100*a*. The direction of the steering wheel and the traveling direction of the main body 200 may be determined by a steering 600 that will be described below.

The main body 200 may not include the separate steering wheel for switching the traveling direction of the main body 200, and the traveling direction of the main body 200 may be determined using a pair of traveling wheels 202 and 204. The traveling direction of the main body 200 may be determined using the rotation direction of each of the pair of traveling wheels 202 and 204 or a difference in rotation speed of the pair of traveling wheels 202 and 204.

The main body 200 may be configured to allow the pair of traveling wheels 202 and 204 to rotate independently with respect to each other and include a pair of traveling motors 206 and 208 for allowing the pair of traveling wheels 202 and 204 to rotate. The pair of traveling motors 206 and 208 may include a right traveling motor 206 for allowing the right traveling wheel 202 of the pair of traveling wheels 202 and 204 to rotate and a left traveling motor 208 for allowing the left traveling wheel 204 of the pair of traveling wheels 202 and 204 to rotate.

The main body 200 may further include a battery 210 for supplying power to each component of the robot 100*a*. The battery 210 may be disposed in the main body 200 in consideration of a center of gravity of the entire robot 100*a*.

The main body 200 may include a housing 220 defining an outer appearance. The housing 220 may be provided as an assembly of a plurality of members. The housing 220 may include a top surface 221, a bottom surface 222, and a circumferential surface 223.

Each of the top surface 221 and the bottom surface 222 of the housing 220 may have a planar shape, and the circumferential surface 223 of the housing 220 may have a curved shape.

The circumferential surface 223 may include a left surface 224, a right surface 225, a rear surface 226, and a front surface 227.

The left surface 224 may be convex toward a left side, and the right surface 225 may be convex toward a right side. And, the rear surface 226 may be convex toward a rear side between an upper end and a lower end. The front surface 227 may be convex forward between the upper and lower ends.

The upper end of the front surface 227 of the circumferential surface 223 may extend closer to a rear end among a front end of the top surface 221 and the rear end of the top surface 221 of the housing 220.

The circumferential surface 223 may further include a plane 228 extending from one side of the convex front surface 227 to the front end of the top surface 221. The plane 228 may be an inclined surface that is inclined to face in a front lower direction.

The housing 220 may further include an upper rear surface 229 extending upward from an upper portion of the convex rear surface 226.

The housing 220 includes a lower housing 220*a* including the top surface 221, the bottom surface 222, and the circumferential surface 223 and an upper housing 220*b* extending from one side of the lower housing 220*a* to protrude upward and including the upper rear surface 229.

The lower housing 220*a* may be provided in a spherical shape of which each of top and bottom surfaces 221 and 222 are flat as a whole.

The upper housing 220*b* may extend from a rear upper portion of the lower housing 220*a* to a rear side of a backrest 320 to be described later.

The traveling wheels 202 and 204 may be rotatably disposed in the housing 220, and a lower portion of each of the traveling wheels 202 and 204 may be disposed in the housing 220 to pass through a wheel through-hole defined in a lower portion of the housing 220.

A space may be defined in the housing 220, and the battery 210 may be accommodated in the space defined in the housing 220.

The robot 100*a* may further include a seating body 300 disposed above the main body 200 and a foot supporter 400 disposed in front of the main body 200.

The seating body 300 may be configured to allow the user to be seated. The seating body 300 may be provided with a seat for allowing the user to be seated thereon. Also, the seating body 300 may be provided with an armrest for allowing a user's arm to be placed. A height of the armrest may be higher than a height of the seat.

The seating body 300 may further include a seat body 310 on which the user sits and a backrest 320 on which the user leans back.

The seat body 310 may include a lower cushion 311 and a lower seat body 312 on which the lower cushion 311 is mounted.

The lower cushion 311 may be disposed on a top surface of the lower seat body 312. The lower cushion 311 may be provided to be more elastic than the lower seat body 312.

The lower seat body 312 may be disposed on an upper portion of the housing 220, in particular, the lower housing 220*a*. The lower seat body 312 may cover a space defined in the housing 220.

The seat body 310 may not include the lower cushion 311, but may include the lower seat body 312.

The backrest 320 may include a rear cushion 321 and a rear seat body 322 supporting the rear cushion 321. The rear seat body 322 may be supported by a rear supporter 324, and the backrest 320 may further include the rear supporter 324.

The rear cushion 321 may be disposed on a front surface of the rear seat body 322. The rear cushion 321 may be provided to be more elastic than the rear seat body 322.

The rear seat body 322 may entirely or partially overlap the upper housing 220*b* in a front-rear direction (i.e., longitudinal direction), and the rear supporter 324 may overlap the upper housing 220*b* in the front-rear direction. The rear seat body 322 and the rear supporter 324 may be protected by the upper housing 220*b*.

A lower portion of the rear supporter 324 may be connected to the lower seat body 312. The rear supporter 324 may be configured so that an upper part thereof is bent with respect to the lower part thereof. The lower portion of the rear supporter 324 may be rotatably connected to the lower seat body 312 by a hinge shaft, and the backrest 320 may be disposed to rotate about the lower portion.

The backrest 320 may not include the rear cushion 321, but may include the rear seat body 322 and the rear supporter 324.

The armrest may be disposed in the seat body 310 so as to move forward and backward. The armrest may be provided in a pair on the seating body 300.

The pair of armrests 330 and 340 may include a right armrest 330 and a left armrest 340 and the right armrest 330 and the left armrest 340 may be spaced apart from each other in the left-right direction Y and may be arranged symmetrical to each other in the left-right direction Y.

The pair of armrests 330 and 340 may be disposed on the seat body 310, in particular, the lower seat body 312 so as to move forward and backward, and a lower portion of each of the pair of armrests 330 and 340 may be inserted into the lower seat body 312. The lower portion of each of the pair of armrests 330 and 340 may be guided to move forward and backward in a front-rear direction X along a guide provided in the seat body 310.

The foot supporter 400 may be disposed on the main body 200. The foot supporter 400 may be disposed on the main body 200 to protrude in the front-rear direction (i.e., longitudinal direction). The foot supporter 400 may be disposed at a front lower portion of the main body 200. The foot supporter 400 may be disposed on the main body 200 to move forward and backward in the front-rear direction X.

An auxiliary wheel supporting the foot supporter 400 may be disposed on the foot supporter 400. A pair of auxiliary wheels may be provided on the foot supporter 400, and the pair of auxiliary wheels 402 and 404 may be disposed the foot supporter 400 so as to be spaced apart from each other in a horizontal direction.

The robot 100*a* may include a steering 600 operated by the user. The steering 600 may be an adjusting device such as a jog & shuttle or a joystick.

The steering 600 may include a handle 612 held by the user. The steering 600 may be an input interface that is held and manipulated by the user's hand to input a traveling direction or traveling speed of the robot 100*a*.

The steering 600 may be disposed on at least one armrest. The steering 600 may be provided on each of the pair of armrests 330 and 340 and may be disposed on one of the pair of armrests 330 and 340.

The steering 600 may include a steering body 610 that is held by the user's hand. The steering body 610 may be a body which is held by the user's hand so as to be manipulated in various directions such as front, rear, left, and right directions. A handle 612 that is held by the user's hand may be disposed on an upper portion of the steering body 610. The steering body 610 may include a steering shaft 614 extending from a lower portion of the handle 612.

The user may hold the handle 612 while sitting on the seat body 310 to push the steering body 610 forward, pull the steering body 610 backward, or push the steering body to a left or right side.

For example, in the steering body 610, the handle 612 is inclined to one side such as the front, rear, left, or right side with respect to the steering shaft 614. The robot 100*a* may include a sensor sensing an inclination angle and an inclination direction of the steering body 610. The robot 100*a* may sense a steering direction or speed by the inclination angle (or inclination angle), the inclination direction, etc. of the steering body 610, which are sensed by the sensor.

For another example, in the steering body 610, the steering shaft 614 and the handle 612 may be disposed to move to the front, rear, left, or right side. The robot 100*a* may include a sensor sensing a position of the steering body 610. The robot 100*a* may sense the steering direction or speed according to the position of the steering body 610, which is sensed by the sensor.

For another example, in the steering body 610, the steering shaft 614 and the handle 612 may be disposed to rotate in a clockwise or counterclockwise direction. The robot 100*a* may include a sensor sensing a rotation angle of the steering body 610. The robot 100*a* may sense the steering direction or speed according to the rotation angle of the steering body 610, which is sensed by the sensor.

The sensor may transmit a signal of the sensed steering direction or speed to a processor 180, and the processor 180 may control the traveling motors 206 and 208 which will be described later according to the signal transmitted from the sensor.

The robot 100*a* may further include a display 700. The display 700 may be disposed on at least one of the pair of armrests 330 and 340. The display 700 may be disposed to rotate about a horizontal rotation center. The display 700 may be an output interface capable of displaying various information such as traveling information.

The display 700 may be rotatably connected to the steering housing 360. The display 700 may be connected to the front end of the steering housing 360.

The display connection portion 364 to which the display 700 is rotatably connected may be provided in the steering housing 360.

The display connection portion 364 may be spaced apart from the steering body 610 in a horizontal direction when the steering body 610 ascends.

The robot 100*a* may further include a display rotator 370 that allows the display 700 to rotate. The display rotator 370 may be a rotating mechanism for allowing the display 700 connected to the display 700 to rotate. The display rotator 370 may include a display motor connected to the display 700 to allow the display 700 to rotate. Hereinafter, for convenience, like the display rotator 370, the display motor will be described with reference numeral 370. The display motor 370 may be disposed to be accommodated in the display connection portion 364. A motor space in which the display motor 370 is accommodated may be defined in the display connection portion 364.

The display motor 370 may be provided with a rotation shaft that allows the display 700 to rotate, and the rotation shaft may be disposed horizontally. The rotation shaft may be lengthily disposed in the left-right direction Y. The display motor 370 may allow the display 700 to rotate so that the display 700 is erected about a rotation axis, or the display 700 is laid down.

In this specification, the display 700 is not limited to being vertically erected, but may be defined to include being erected at a predetermined angle.

The display 700 may include a front surface 701 facing a front side and a rear surface 702 facing a rear side with respect to the standing display 700. A screen that is capable of providing a variety of information to the user may be disposed on the rear surface 702 of the display 700. A touch screen may be disposed on the rear surface 702 of the display 700, and the user may input various commands through the touch screen.

The display 700 may rotate side by side with the top surface of the armrest on the armrest. In this case, the front surface 701 when the display 700 is erected may be a top surface of the display 700, and the rear surface 702 when the display 700 is erected may be a bottom surface of the display play 700.

When the display 700 is laid horizontally, the screen of the display 700 is hidden from the outside, and the screen of the display 700 may be protected.

The robot 100*a* may further include at least one accessory that provides convenience to the user.

The accessory may be provided on the armrest or the main body 200, and a plurality of accessories may be provided on the robot 100*a*.

The robot 100*a* may include an accessory 800 (armrest accessory) provided on the armrest. The robot 100*a* may include an accessory 900 provided on the main body 200 (body accessory). The robot 100*a* may include both the accessory 800 provided on the armrest and the accessory 900 provided on the main body 200.

For example, the accessory 800 provided on the armrest may be a cup holder into which a cup is seated. For another example, the accessory 800 provided on the armrest may be a sub armrest having the same size and shape as the steering housing 360 but without an opening 362 defined in an upper portion thereof.

The steering housing 360 according to this embodiment may be selectively disposed on the armrest body 350 of the left armrest 340 or the armrest body 350 of the right armrest 330 for the convenience of the user. That is, the accessory such as the cup holder or a sub armrest may be disposed on the armrest body 350 of the armrest, in which the steering housing 360 is not disposed, among the left armrest 340 and the right armrest 330 and may support the user's arm together with the armrest body 350.

The accessory 800 provided on the armrest is not limited to the cup holder or the sub armrest, and also is not limited to the kind thereof as long as it provides the user's convenience and is accommodated in the accommodation portion 352.

For example, the accessory 900 provided on the main body 200 may be a supporter on which a user's baggage (e.g., a carrier) is placed. For another example, the accessory 900 provided on the main body 200 may be a holder on which a medical device (e.g., crutches, medicines, etc.) to assist user's walk. The accessory 900 provided on the main body 200 is not limited to the holder, and also, the accessory 900 is not limited in kind as long as the accessory 900 moves with the user. Various kinds of accessories 900 may be separably attached to the main body 200.

An opening 362 may be defined in the armrest, and an inner space S in which a portion of the steering 600 is accommodated may be defined in the armrest. When the robot 100*a* includes a pair of armrests 330 and 340, the steering 600 may be disposed on one of the pair of armrests 330 and 340.

At least one of the pair of armrests 330 and 340 may be an assembly of a plurality of members, and at least one of the pair of armrests 330 and 340 may include the armrest body 350 and the steering housing 360.

One of the pair of armrests 330 and 340 330 may include the armrest body 350 and the steering housing 360 disposed on the armrest body 350. An accommodation portion 352 in which the steering housing 360 is accommodated may be defined in the armrest body 350.

The accommodation portion 352 may be provided in a shape that is recessed in the armrest body 350. A top surface of the accommodation portion 352 may be opened. Each of the top and front surfaces of the accommodation portion 352 may be opened.

The steering housing 360 may be inserted into and accommodated in the accommodation portion 352 and may be protected by the accommodation portion 352.

The steering housing 360 may surround at least a portion of the steering 600 and may protect the steering 600.

The other one of the pair of armrests 330 and 340 may include the armrest body 350 and may further include an accessory 800 disposed on the armrest body 350. The armrest body 350 may be provided with the accommodating portion 352 in which the accessory 800 is accommodated.

The pair of armrests 330 and 340 may include the armrest body 350 having the same structure, and the steering housing 360 and the accessory 800 may be disposed symmetrical to each other in the horizontal direction. Each of the pair of armrests 330 and 340 may be provided with the accommodation portions 352 having the same shape and the same size.

The accessory 800 and the steering housing 360 may have the same size and outline shape.

The steering housing 360 and the accessory 800 may have the same shape and size and may be disposed symmetrical to each other with respect to the seating body 300.

The steering housing 360 may constitute a steering assembly together with steering 600. The steering assembly may be selectively disposed together with the accessory 800.

When the steering housing 360 is disposed on the armrest body 350 of the right armrest 330, the accessory 800 may be disposed on the armrest body 350 of the left armrest 340, and vice versa. When the steering housing 360 is disposed on the armrest body 350 of the left armrest 340, the accessory 800 may be disposed on the armrest body 350 of the right armrest 330.

Figure 8:
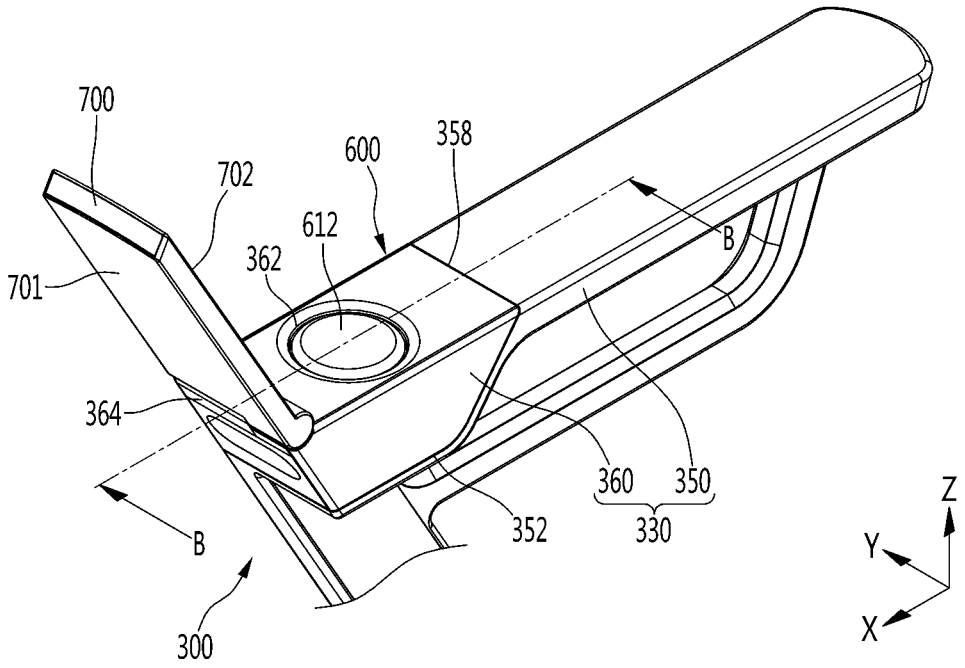
FIG. 8 is a perspective view of a steering body and a display when the steering body of FIG. 4 descends.
Figure 9:
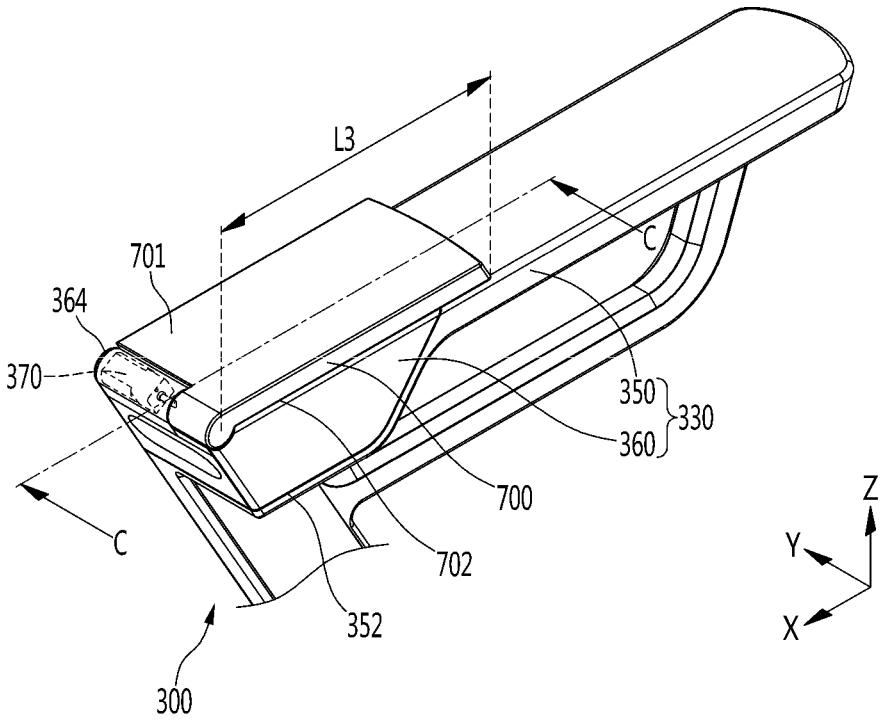
FIG. 9 is a perspective view illustrating a state in which the display of FIG. 8 covers the steering body.
Figure 10:
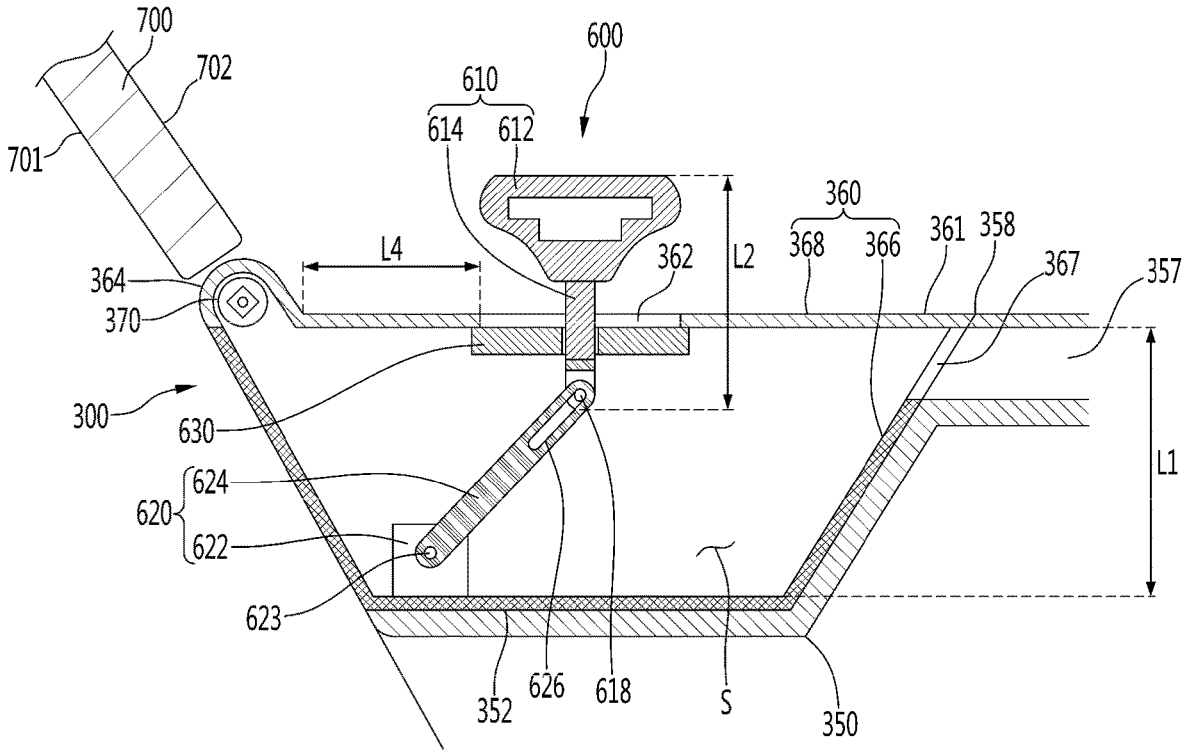
FIG. 10 is a cross-sectional view taken along line A-A of FIG. 4.
Figure 11:
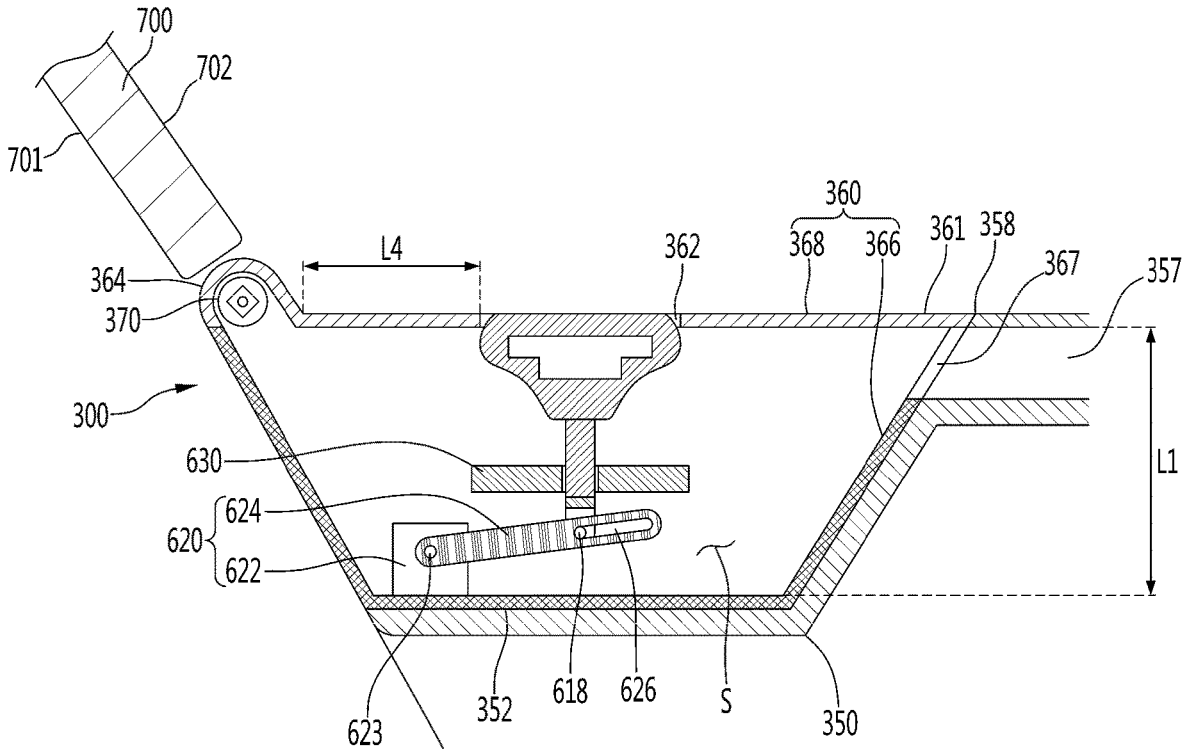
FIG. 11 is a cross-sectional view taken along line B-B of FIG. 8.
Figure 12:
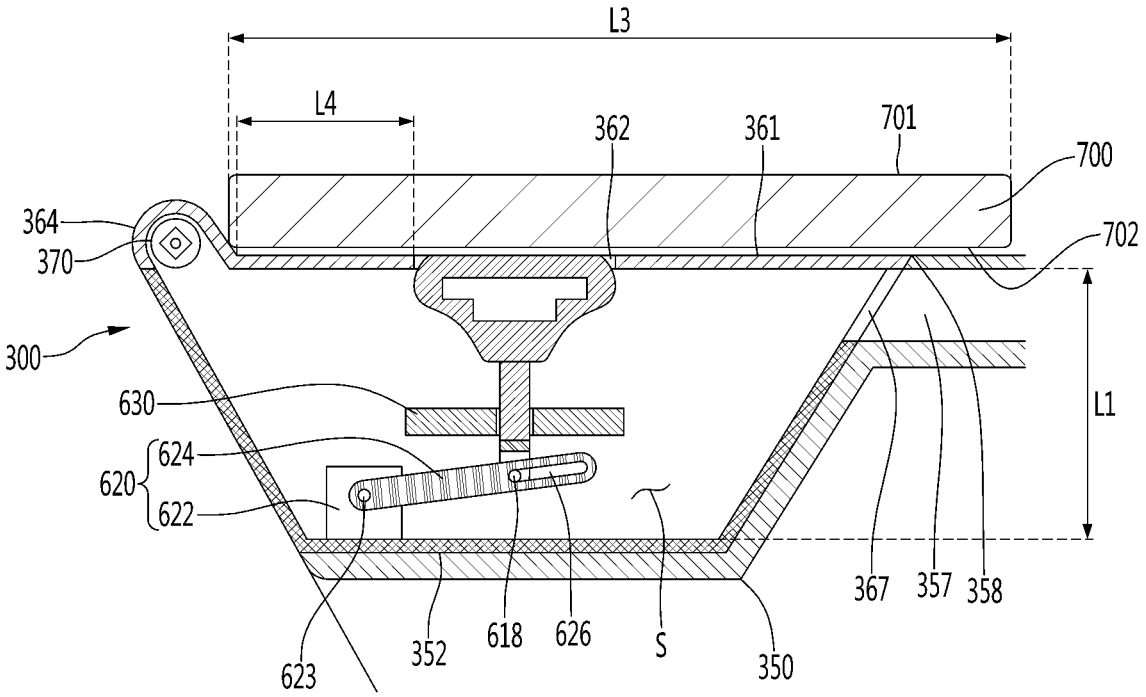
FIG. 12 is a cross-sectional view taken along line C-C of FIG. 9.

FIG. 8 is a perspective view of the steering body and the display when the steering body of FIG. 4 descends, FIG. 9 is a perspective view illustrating a state in which the display of FIG. 8 covers the steering body, FIG. 10 is a cross-sectional view taken along line A-A of FIG. 4, FIG. 11 is a cross-sectional view taken along line B-B of FIG. 8, and FIG. 12 is a cross-sectional view taken along line C-C of FIG. 9.

An opening 362 may be defined in an upper portion of the steering housing 360, and an inner space S may be defined in the steering housing 360. A vertical length L1 of the inner space S may be longer than a vertical length L2 of the steering body 610.

The vertical length L1 of the inner space S may be longer than the vertical length L2 of the steering body 610. The steering housing 360 may be coupled to the armrest body 350, particularly, the accommodation portion 352, by a coupling member such as a screw.

The steering housing 360 may include a lower housing 366 having an inner space S defined therein and a steering top cover 368 disposed on an upper end of the lower housing 366 to cover the inner space S.

A wire through-hole 367 through which a wire connected to a motor 622, which will be described later, or extending to the inside of the steering housing 360 passes may be defined in the lower housing 366.

The lower housing 366 may be provided with a coupling portion such as a coupling boss to which the coupling member such as the screw is coupled.

The lower housing 366 may include a portion facing the armrest body 350, and the wire through-hole 367 may be defined in a portion facing the armrest body 350. On the other hand, a wire through-hole 357 which communicates with the wire through-hole 367 and through which the wire passes may be defined in the armrest body 350.

An opening 362 may be defined in one side of the steering top cover 368 to pass in the vertical direction.

A handle 612 may be disposed on an upper portion of the steering body 610. The steering body 610 may pass through the opening 362. A lower portion of the steering body 610 may be accommodated in the inner space S.

The steering 600 may include an elevator 620.

The elevator 620 may be accommodated in the inner space S to elevate the steering body 610. The elevator 620 may be connected to the lower portion of the steering body 610 to elevate the steering body 610.

The elevator 620 may allow the handle 612 to ascend above the opening 362 at a height higher than the opening 362 and may allow the handle 612 to descend to the opening 362. When the handle 612 descends to the opening 362, the opening 362 of the steering housing 360 may surround an outer circumference of the handle 612.

In the elevator 620, when the steering body 610 descends, a height of an upper end of the handle 612 matches a height of the top surface of the steering housing 360, or a height of an upper end of the handle 612 is greater than a height of the top surface of the steering housing 360 so that the steering body 610 descends.

The elevator 620 may allow the steering body 610 to ascend when the steering body 610 ascends so that the height of the upper end of the handle 612 is higher than the height of the top surface of the steering housing 360.

The elevator 620 may include a motor 622 and at least one power transmission member connected to the motor 622. The power transmission member may include at least one lever 624.

The motor 622 may be accommodated in the inner space S defined in the armrest. The motor 622 may be accommodated in the steering housing 360 of the armrest.

The lever 624 may be connected to the steering body 610 to allow the steering body 610 to descend or ascend. The lever 624 may be connected to a rotation shaft 623 of the motor 622 to rotate. The lever 624 may be connected to a lower portion of the steering body 610. The lever 624 may be connected to a connection shaft 618 disposed under the steering body 610. The connection shaft 618 may be disposed horizontally under the steering body 610.

A guide hole 626 that guides the connection shaft 618 to be movable may be defined in the lever 624. The guide hole 626 may be lengthily defined in a longitudinal direction of the lever 624.

The steering 600 may further include an inner cover 630.

The inner cover 630 may be connected to the steering body 610. The inner cover 630 may be elevated together with the steering body 610 when the steering body 610 is elevated.

An area of the inner cover 630 may be greater than an opening area of the opening 362.

The inner cover 630 may block the opening 362 when the steering body 610 ascends. When the inner cover 630 ascends, an edge of the inner cover 630 may contact a peripheral bottom surface of the opening 362 of the steering housing, and the inner cover 630 may be disposed below the opening 362 to block the opening 362. That is, the inner cover 630 may limit the upward travel of the steering 610 by contacting an inner surface of the top surface 361 of the steering housing 360.

The inner cover 630 may descend below the opening 362 when the steering body 610 descends, and the edge of the inner cover 630 may be spaced apart from the peripheral bottom surface of the opening 362 of the steering housing 360 in the vertical direction.

The accommodation portion 352 in which the steering housing 360 is inserted and accommodated may be recessed in the armrest body 350.

The display 700 may have a size larger than a size of the opening 362. A length L3 of the display 700 may be longer than a distance L4 between the display connection portion 364 and the opening 362.

The display 700 may cover the opening 362 when the display 700 rotates to cover the top surface 361 of the steering housing 360.

The display 700 may be larger than the top surface 361 of the steering housing 360. When the display 700 rotates to cover the top surface 361 of the steering housing 360, the display 700 may have a size that is enough to cover a boundary 358 between the steering housing 360 and the armrest body 350.

The display 700 may be disposed above the opening 362 to cover the opening 362 when the steering body 610 descends, and the display 700 rotates to cover the top surface of the steering housing 360. The opening 362 and the handle 612 may be covered by the display 700.

The motor 622 and the display motor (i.e., display rotator) 370 of the elevator 620 may operate at the same time or at a time difference.

In use of the steering 600, before the motor 622 allows the lever 624 to rotate upward, the display motor 370 may be driven to allow the display 700 to rotate in a direction in which the display 700 opens the opening 322, and also, when the display motor 370 is erected upward, the display motor 370 may be stopped.

When the display 700 is erected upward, the motor 622 may allow the lever 624 to rotate upward, and the handle 612 of the steering body 610 may ascend higher than the opening 362. When the steering body 610 completely ascends, the motor 622 may be stopped.

In the use of the steering 600, if the display motor 370 is driven first and then stopped, the motor 622 may be driven and then stopped. In the use of the steering 600, when the display motor 370 and the motor 622 are sequentially driven/stopped, damage or breakage of the display 700 by the steering body 610 may be minimized.

When the steering 600 is not used, the motor 622 may allow the lever 624 to rotate downward, and when the steering body 610 completely descend to the inner space S, the display motor 370 may allow the display 700 to rotate so that the display 700 covers the opening 322.

When the steering 600 is not used, if the motor 622 is driven first and then stopped, the display motor 370 may be stopped after being driven. When the steering 600 is not used, when the motor 622 and the display motor 370 are sequentially driven/stopped, the damage or breakage of the display 700 by the steering body 610 may be minimized, and also, malfunction of the steering body 610 by the display 700 may be minimized.

Figure 13:
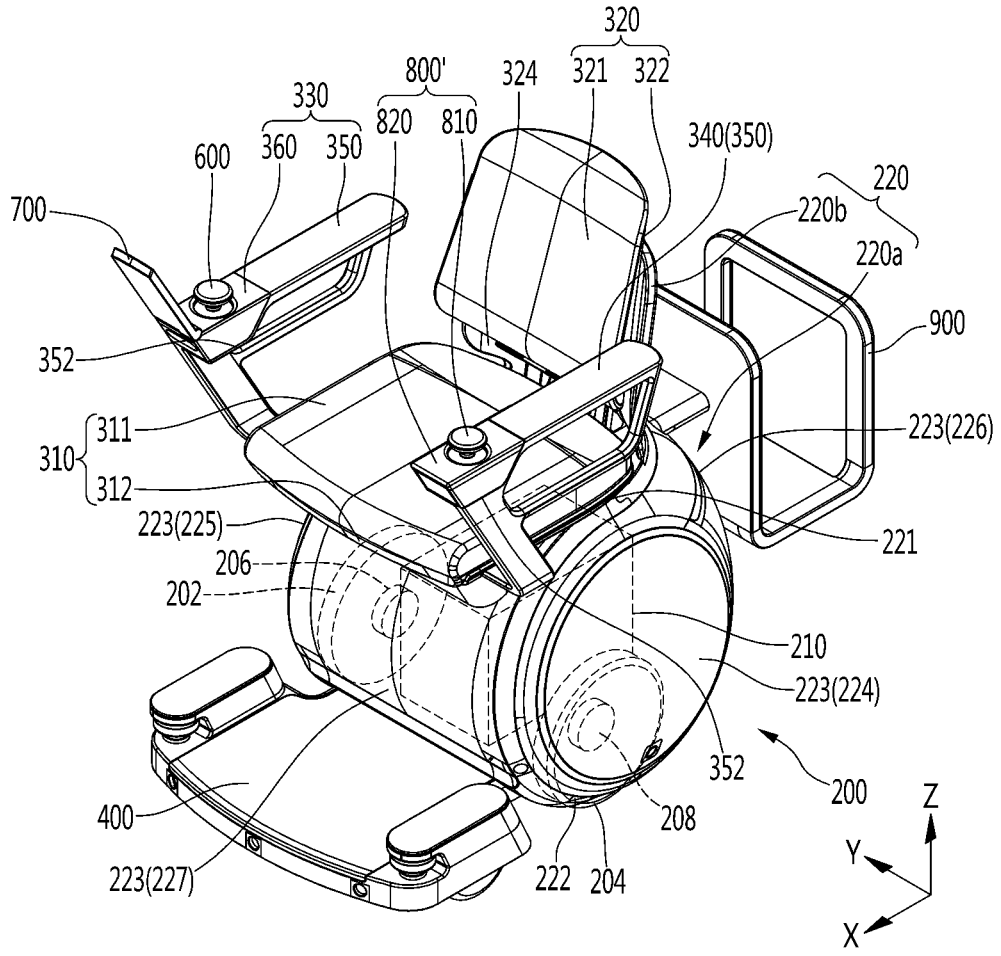
FIG. 13 is a perspective view illustrating a state in which a sub steering is disposed on an armrest according to an embodiment.

FIG. 13 is a perspective view illustrating a state in which a sub steering is disposed on an armrest according to an embodiment.

An accessory 800' illustrated in FIG. 13 may include a sub steering 810 provided on the seating body 300 together with the steering 600 and a sub steering housing 820. The accessory 800' may be installed instead of the accessory illustrated in FIG. 6.

The sub steering 810 may be disposed symmetrical to the steering 600 in the horizontal direction.

The user may alternatively operate either the sub steering 810 or the steering 600 or may operate the sub steering 810 and the steering 600 together.

The elevator 620 may allow the steering body 610 of the steering 600 to descend into the steering housing 360. In this case, the user may operate the robot **100*a* using the sub steering 810**.

According to an embodiment, when the steering body 610 is used, the steering body 610 may ascend to assist the user's traveling operation. When the steering body 610 is not used, the steering body 610 may ascend to minimize the contamination or damage to the steering body 610.

Also, when the display 700 is erected, and the steering body 610 ascends, the display 700 may protect the steering body 610 and the user's hands in front of the steering body 610.

Also, if the steering body 610 descends, and the display 700 covers the top surface of the steering 600, the steering body 610 may be hidden by the display 700 so that the outer appearance of the robot **100*a* is simply shown, and also, the attachment of the foreign substances such as the dust to the steering housing 610 or the steering 600** may be minimized.

Also, when the display 700 covers the top surface of the steering housing 610, the opening 362 may be covered to minimize penetration of the foreign substances such as the dusts into the steering housing 610 through the opening 361. Therefore, the screen of the display 700 may be protected by the steering housing 360.

Also, since positions of the steering and accessory are changeable to the left and right sides, there is an advantage that the operation convenience of the steering is high.

The above-disclosed subject matter is to be considered illustrative, and not restrictive, and the appended claims are intended to cover all such modifications, enhancements, and other implementations, which fall within the scope of the present disclosure.

Thus, the implementation of the present disclosure is to be considered illustrative, and not restrictive.

Therefore, the scope of the present disclosure is defined not by the detailed description of the invention but by the appended claims, and all differences within the scope will be construed as being included in the present disclosure.

What is claimed is:

1. A robot, comprising:

a main body, the main body including:

a wheel; and a wheel motor, the wheel motor being configured to move the wheel; and a seating body, the seating body including:

a seat;

an armrest including a steering housing, the steering housing including an upper portion having an opening and an inner space; and a steering configured to steer the robot by controlling the wheel motor, the steering being at least partially disposed within the steering housing, the steering including:

a steering body including an upper portion and a lower portion; and an elevator accommodated in the inner space of the steering housing, the elevator being connected to the lower portion of the steering body and being configured to move the steering body, wherein the upper portion of the steering body includes a handle, the handle being configured to pass through the opening of the steering housing, wherein the lower portion of the steering body is accommodated in the inner space, and wherein the elevator is configured to move the steering body to allow the handle to ascend to a first position above the opening and to descend from the first position to a second position below the opening.

2. The robot according to claim 1, wherein the armrest includes a recess portion, and wherein the steering housing is provided in the recess portion of the armrest.

3. The robot according to claim 1, wherein the steering further comprises an inner cover connected to the steering body, wherein the inner cover is provided in the inner space of the steering housing, and wherein the inner cover is configured to block the opening of the steering housing when the steering body ascends.

4. The robot according to claim 1, wherein a height of the inner space of the steering housing is greater than a height the steering body.

5. The robot according to claim 1, wherein the lower portion of the steering body includes:

a steering shaft extending from a lower portion of the handle; and a connection shaft connected to the steering shaft, and wherein the elevator comprises:

an elevator motor accommodated in the steering housing, the elevator motor including a rotation shaft; and a lever including a first end and a second end, wherein the first end of the lever is connected to the rotation shaft of the elevator motor, the lever being configured to move in response to rotation of the rotation shaft by the elevator motor, and wherein the second end of the lever is connected to the connection shaft.

6. The robot according to claim 5, wherein the second end of the lever includes a guide hole, the guide hole being oblong and having a length greater than a diameter of the connection shaft, wherein the connection shaft extends through the guide hole, and wherein in response to rotation of the rotation shaft of the elevator motor, the connection shaft moves within the guide hole.

7. A robot comprising:

a main body, the main body including:

a wheel; and a wheel motor, the wheel motor being configured to move the wheel; and a seating body, the seating body including:

a seat;

an armrest including a steering housing, the steering housing including an upper portion having an opening and an inner space; and a steering configured to steer the robot by controlling the wheel motor, the steering being at least partially disposed within the steering housing, the steering including:

a steering body including an upper portion and a lower portion; and an elevator accommodated in the inner space of the steering housing, the elevator being connected to the lower portion of the steering body and being configured to move the steering body, wherein the upper portion of the steering body includes a handle, the handle being configured to pass through the opening of the steering housing, wherein the lower portion of the steering body is accommodated in the inner space, and wherein the robot further includes a display rotatably connected to the steering housing.

8. The robot according to claim 7, wherein the display has a length greater than a length of the opening of the steering housing, and wherein the display is configured to rotate to cover a top surface of the steering housing and to cover an entirety of the opening of the steering housing.

9. The robot according to claim 7, wherein the display is connected to a front end of the steering housing, wherein a size of the display is greater than a size of a top surface of the steering housing, and wherein the display is configured to rotate to cover the top surface of the steering housing.

10. A robot, comprising:

a main body, the main body including:

a wheel; and a wheel motor, the wheel motor being configured to move the wheel; and a seating body, the seating body including:

a seat;

a first armrest, the first armrest including a steering housing, the steering housing including:

an upper portion having an opening; and an inner space;

a second armrest, the second armrest including an accessory; and a steering configured to steer the robot by controlling the wheel motor, the steering being at least partially disposed within the steering housing, the steering including:

a steering body including an upper portion and a lower portion; and an elevator accommodated in the inner space of the steering housing, the elevator being connected to the lower portion of the steering body and being configured to move the steering body, wherein the upper portion of the steering body includes a handle, the handle being configured to pass through the opening of the steering housing, wherein the lower portion of the steering body is accommodated in the inner space, wherein the accessory includes a sub steering, and wherein the sub steering is configured to steer the robot by controlling the wheel motor.

11. The robot according to claim 10, wherein the first armrest further includes a display rotatably connected to the steering housing.

12. The robot according to claim 11, wherein the upper portion of the steering housing includes a display connection portion, wherein the display is rotatably connected to the display connection portion of the steering housing, and wherein the display connection portion is horizontally spaced apart from the opening of the steering housing.

13. The robot according to claim 12, wherein the display has a length greater than a length of the opening of the steering housing, and wherein the display is configured to rotate to cover a top surface of the steering housing and to cover an entirety of the opening of the steering housing.

14. The robot according to claim 10, wherein the steering further comprises an inner cover connected to the steering body, wherein the inner cover is provided in the inner space of the steering housing, and wherein the inner cover is configured to block the opening of the steering housing when the steering body ascends.

15. The robot according to claim 10, wherein the lower portion of the steering body includes:

a steering shaft extending from a lower portion of the handle; and a connection shaft connected to the steering shaft, wherein the elevator comprises:

a motor accommodated in the steering housing, the motor including a rotation shaft; and a lever including a first end and a second end, wherein the first end of the lever is connected to the rotation shaft of the motor, the lever being configured to move in response to rotation of the rotation shaft by the motor, and wherein the second end of the lever is connected to the connection shaft.

* * * * *